United States Patent [19]

Langford, Jr. et al.

[11] 4,058,177

[45] Nov. 15, 1977

[54] ASYMMETRIC GAGE INSERT FOR AN EARTH BORING APPARATUS

[75] Inventors: James W. Langford, Jr., Red Oak; Wilbur S. Keller, Arlington, both of Tex.

[73] Assignee: Dresser Industries, Inc., Dallas, Tex.

[21] Appl. No.: 775,226

[22] Filed: Mar. 7, 1977

Related U.S. Application Data

[63] Continuation of Ser. No. 671,535, March 29, 1976, abandoned.

[51] Int. Cl.[2] ..... E21B 9/10; E21B 13/01

[52] U.S. Cl. ..... 175/374; 175/410

[58] Field of Search ..... 175/374, 410

[56] References Cited

U.S. PATENT DOCUMENTS

| | | | |
|---|---|---|---|
| 948,269 | 2/1910 | Crowley | 175/410 |
| 3,442,342 | 5/1969 | McElya | 175/374 |
| 3,495,668 | 2/1970 | Schumacher | 175/374 |
| 3,522,852 | 8/1970 | Bardwell | 175/410 |

FOREIGN PATENT DOCUMENTS

| | | | |
|---|---|---|---|
| 211,516 | 3/1962 | Sweden | 175/410 |

*Primary Examiner*—James A. Leppink
*Attorney, Agent, or Firm*—Eddie E. Scott

[57] ABSTRACT

An asymmetric gage row insert provides a larger amount of wall contacting surface thereby decreasing the wear on the gage insert and increasing the ability of the earth boring apparatus to maintain a full gage hole. The insert has a shape prior to assembly onto the earth boring apparatus that includes a base integrally joined to an asymmetric head. The base is mounted in a socket in the earth boring apparatus. The head projects from the earth boring apparatus and includes an extended gage cutting surface. The gage cutting surface is the largest plane surface on the head. The gage cutting surface contacts the wall of the hole with the majority of the length of its extended surface and with the same angle as the gage angle of the bit.

10 Claims, 7 Drawing Figures

ASYMMETRIC GAGE INSERT FOR AN EARTH BORING APPARATUS

This is a continuation, of application Ser. No. 671,535, filed Mar. 29, 1976 now abandoned.

BACKGROUND OF THE INVENTION

The present invention relates in general to the art of earth boring and more particularly to a cutting element for an earth boring apparatus.

Earth boring apparatus having hard insert elements mounted in a cutter member body are utilized in the boring of holes in the earth because of the ability of the hard insert cutting elements to penetrate the earth formations. A problem has been encountered with this type of apparatus, and generally with all earth boring apparatus, in maintaining the desired diameter or gage of the hole being bored. This is important in the boring of raise holes and tunnels as well as being critically important in the drilling of oil and gas wells and the like. For example, in the drilling of a deep well wherein more than one bit will be used in the well, the gage cutting inserts must maintain the hole at the full diameter. Otherwise, it would be necessary for the next bit being lowered into the hole to ream the undersized hole out to the desired diameter before the new bit reached drilling depth and could begin drilling its length of assigned hole. Such reaming action would reduce the useful lifetime of the second bit because by the time the second bit reached its assigned drilling depth, a substantial part of the lifetime of the gage cutting elements would be exhausted.

The inserts in the gage row are exposed to the most rigorous drilling. They must drill a larger area of the hole. In addition, the formation outwardly of the gage row of inserts is not being drilled and hence provides some degree of lateral support for the formation being drilled by the gage row. It will be appreciated that an improvement in the ability of an earth boring apparatus to maintain gage will be an improvement of the entire earth boring apparatus and contribute significantly to the performance efficiency, economy, and life of the earth boring apparatus.

BRIEF DESCRIPTION OF PRIOR ART

In the prior art the accepted method of determining the exact bit diameter was to grind the outer or gage surface of the gage compact. This would produce a flat on the surface of the gage insert. The flat would contact with the wall of the hole. It is impractical to grind the outer or gage surface of the existing gage inserts to the extent necessary to contact the wall of the hole with the majority of the length of their extended surfaces. In addition, the grinding of the inserts reduces the overall strength of the insert.

In U.S. Pat. No. 3,442,342 to F. H. McElya and R. A. Cunningham patented May 6, 1969 a specially shaped insert for compact rock bits and rolling cutters and rock bits using such inserts is shown. The original inserts of cemented tungsten carbide had hemispherical cutting tips, and rock bits using such inserts were used to drill the hardest abrasive formations, such as taconite, bromide, and chert. This shape is not particularly effective for the drilling of abrasive formations of medium hardness, e.g., hard shales, dolomite, and some limestones, and the inventors herein have developed inserts with more of a chisel or wedge shape to cut such rock. At the same time, they avoid the pitfalls of the "roof-top" style of cutting tip, one in which there are two flanks with flat surfaces converging to a flat crest.

Two basic shapes of cutting tips are disclosed: (1) a modified chisel with convex flanks converging to a crest which is convex along both its elongated lengths and its uniform narrow width, the flanks being normal to a common plane passing through the axis of the insert so that their projected intersection is a curve normal to such axis: and (2) a wedge shape in which the flanks are twisted or canted away from each other so that there is no single plane through the insert axis which is normal to both flanks and the projected intersection is not normal to the axis, the result being that the crest formed normal to the axis increases in width from one end to the other.

In all forms rounded intersections are provided to avoid the sharp corners and sharp edges which cause high-stress concentration. The inventor's theory is that their rounding and their convex surfaces distribute the operating load over the cutting edge of the insert and direct such load to the center of the insert, thus avoiding the high-stress at the edges which they believe to be responsible for the shipping and breaking of roof-top inserts.

In U.S. Pat. No. 2,990,025 to M. L. Talbert and W. E. Scarborough patented June 27, 1961 an improved arrangement of wear-resistant inserts to maintain the hole being drilled at gage is shown. A first circumferential row of gage cutting wear-resistant inserts is situated at the heel of the cutter. A second circumferential row of wear-resistant inserts is spaced inwardly of the first row toward the longitudinal axis of the head with the spacing between the first and second rows being such that the track of the second row on the bottom of the hole being drilled overlaps the track of the first row. The first row is situated at a substantially zero oversized angle and the second row is situated at a larger oversized angle than is the first row so that the second row effects disintegration of the earthen formations closely adjacent the wall of the hole at a level below the first row, whereby the formation to be disintegrated by the first row is left without substantial inner lateral support thereby facilitating cutting the hole to gage by the first row.

In U.S. Pat. No. 3,800,891 to A. D. White and A. E. Wisler patented Apr. 2, 1974 a hardfacing composition and gage hardfacing on rolling cutter rock bits is shown. This patent relates to a tooth-type bit rather than an insert bit, however, the patent points out the importance of maintaining the proper gage. Beginning at column 1, line 49, the importance of maintaining gage is discussed as follows "the importance of such gage maintaining function in an oil well can scarcely be exaggerated. Since all subsequent operations such as running in casing and cementing it in place depend on having a full gage hole, the customer demands and obtains it in one way or another. If a bit drills an undersized hole, the following bit must be used to ream the hole to full gage, even if in so doing the second bit becomes useless for further drilling. Needless to say, the bit which drilled the undersized hole will not be reordered if a better one is available. Thus, the gage surface of a rolling cutter used in oil field drilling is completely unlike many other bits used in drilling rock, and must even be better than the bottom--cutting structure of the same rolling cutter on which it is employed. Wear of a gage surface cannot be tolerated, whereas it makes little difference if the teeth which cut the inner part of the hole gradually wear away, so long as they continue to penetrate effectively."

In U.S. Pat. No. 2,774,570 to R. A. Cunningham patented Dec. 18, 1956 a roller cutter for earth drills is shown. The rolling cutter includes an annular series of cylindrical inserts of hard wear-resistant material having their axis extending outwardly and substantially normal to the surface of the body and presenting protrusions at the surface thereof to affect disintegrating action and to maintain gage of the well bore being drilled.

SUMMARY OF THE INVENTION

The present invention provides more surface on the gage row inserts for contacting the wall of the bore hole. This decreases wear on the gage inserts and therefore increases the ability of the earth boring apparatus to maintain a full gage hole. The insert of the present invention contacts the wall of the hole with the majority of the length of its extended surface and with the same angle as the gage angle of the earth boring apparatus and maintains maximum hole gage retaining ability. The earth boring apparatus includes at least one cutter member for forming a hole in the earth. The cutter member has an annular gage row of inserts mounted in sockets in the cutter member body for cutting the gage of the hole. The inserts have a shape prior to assembly in the sockets that includes an asymmetric head with an extended gage contacting face. The gage contacting face is planar and is substantially larger than any other planar face on the head. The above and other features and advantages of the present invention will become apparent from a consideration of the following detailed description of the invention when taken in conjunction with the accompanying drawings.

DETAILED DESCRIPTION OF THE INVENTION

Figure 1:
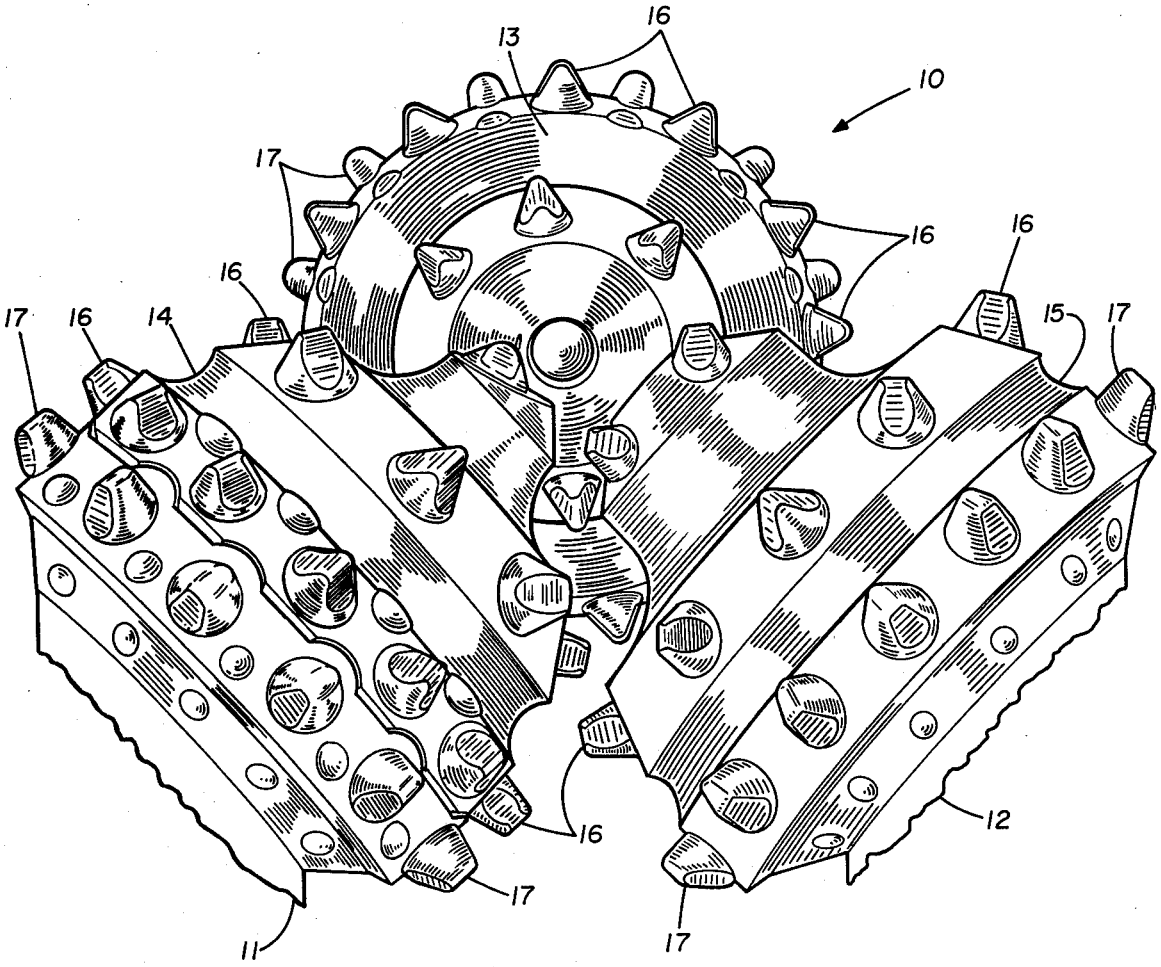
FIG. 1 is a cut-away perspective illustration of a three-cone rolling cutter rock bit embodying the present invention.

Referring now to the drawings and to FIG. 1 in particular, a rotary rock bit generally designated by the reference character 10 embodying the present invention is illustrated. The bit 10 includes a bit body adapted to be connected at its pin end to the lower end of a rotary drill string (not shown). The bit body includes a passage providing communication for drilling muds or the like passing downwardly through the drill string to allow the drilling mud to be directed to the bottom of the well bore and pass upward in the annulus between the wall of the well bore and the drill pipe carrying cuttings and drilling debris therewith.

Depending from the body of the bit are three substantially identical arms. Arms 11 and 12 are shown in FIG. 1. The lower end portion of each of the arms is provided with a conventional bearing pin. Each arm rotatably supports a generally conical cutter member. The cutter members being designated 13, 14, and 15 in FIG. 1. The bearing pins carrying the cutting members 13, 14, and 15 define axis of a rotation respectively about which the cutter members rotate. The axis of rotation are tilted downwardly and inwardly at an angle. The direction of rotation of drill bits is in a clockwise direction so that the threads making up the various joints of the drill string are constantly tightened by the forces exerted as the drill string rotates the bit 10.

Each of the cutter members 13, 14, and 15 includes a nose portion that is oriented toward the bit axis of rotation and a base that is positioned at the intersection between the wall of the well bore and the bottom thereof. The cutting action of the base defines the diameter or gage of the well bore.

Each of the cutter members 13, 14, and 15 includes annular rows of inserts 16 for destroying the inner portion of the hole. Each of the cutter members 13, 14, and 15 also include annular rows of inserts 17 that are located adjacent the base of each cutting member. The inserts 17 cut the intersection between the well bore wall and the bottom thereof. The annular rows of inserts 17 are generally referred to as "gage rows" and the inserts 17 are designated "gage inserts." The gage row inserts are subjected to the most rigorous drilling action.

The present invention affords more surface for the gage row inserts to contact the wall of the hole. This decreases wear on the gage inserts, therefore increasing the ability of the bit to maintain a full gage hole. Applicants have provided an insert which contacts a wall of the hole with the majority of the length of its extended surface and with the same angle as the gage angle of the bit. This insert is believed to have the maximum gage retaining ability.

In the prior art the accepted method of determining the exact bit diameter was to grind the outer or gage surface of the gage compact. This would produce a flat on the surface of the gage insert. The flat would contact the wall of the hole. It is impractical to grind the outer or gage surface of the existing gage inserts to the extent necessary to contact the wall of the hole with the majority of the length of their extended surfaces. In addition, the grinding of the inserts reduces the overall strength of the insert.

Figure 2:
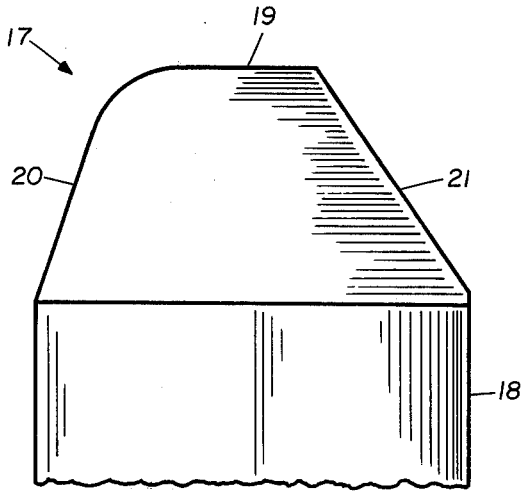
FIG. 2 is an enlarged side view illustration of a gage row insert of the bit shown in FIG. 1.

Referring now to FIG. 2, a side view of one of the gage inserts 17 is shown enlarged and in greater detail. The outer or gage angle $\alpha$ of this compact before gage grind is within 1° 30′ of the gage angle of the bit. It is not necessary to grind the outer or gage surface excessively to bring the insert gage angle to the bit gage angle. The inner angle $\beta$ of this compact is considerably less than the outer or gage angle $\alpha$. This difference between the inner and outer angles allows the length of the crest 19 to approximate that of conventional gage inserts. The sides or flank surfaces of the gage insert can be flat or convex surfaces, convex surfaces on the flanks result in a larger flat area on the outer angle than do the flat angled flanks.

Figure 3:
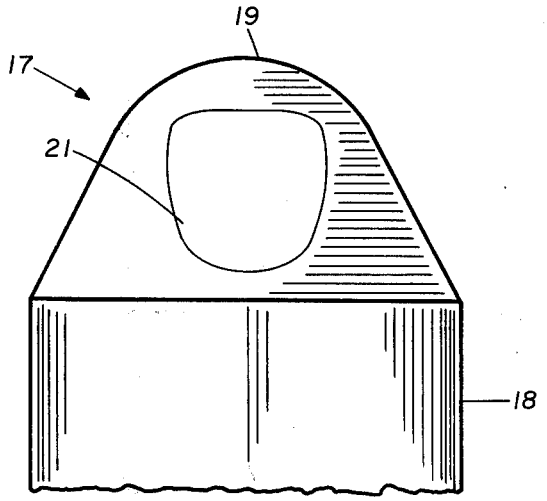
FIG. 3 is an end view of the insert shown in FIG. 2 showing the gage cutting surface.

Referring now to FIG. 3, an end view of the insert 17 shown in FIG. 2 is illustrated. The insert 17 contacts the wall of the hole with the majority of its extended surface 21 and with substantially the same angle as the gage angle of the bit. The surface 21 is the largest plane surface on the cutting head of the insert 17. The plane surface 21 contacts the wall of the hole and performs the gage cutting function. Since the surface 21 is relatively large compared to other surfaces on the insert 17, the lifetime of the insert 17 will be increased.

The insert 17 is formed by pressing granules of a wear-resistant material such as tungsten carbide together with granules of a binder such as cobalt. The wear-resistant material granules and binder granules are pressed together with wax and formed in the desired insert shape. The head of the insert may be formed in a die. For example, the head of the insert may be formed by a punch member which molds the end of the insert into the desired finished shape. The inserts are dewaxed in a furnace and sintered at a higher temperature in a furnace. The insert is then press fit into the body of a cutter member with the asymmetric head oriented so that the extended plane surface of the insert is at gage. Very little, if any, gage grinding is required.

The foregoing should be contrasted with prior art inserts having symmetrical heads. The prior art inserts are pressed into the cutter member and subsequently a gage surface is ground around the gage of a cutter producing ground flats on the gage inserts. The inserts of the present invention are pressed into the cutter with the pre-formed plane gage contacting surface located at substantially the gage angle of the bit.

Figure 4:
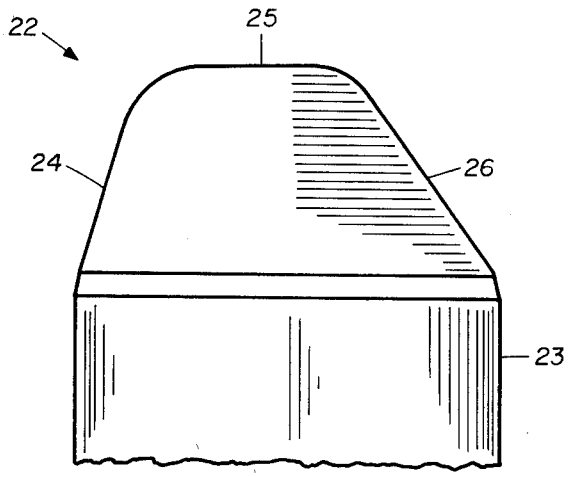
FIG. 4 is a side view of another insert constructed in accordance with the present invention.

Referring now to FIG.4, a side view of another embodiment of an insert 22 is shown in some detail. The insert 22 includes a cylindrical body portion 23 adapted to be mounted in a socket in the cutter body. The head of the insert 22 includes an inner surface 24 and an outer or gage surface 26. The outer or gage surface 26 is substantially larger than the inner surface 24. The roof top or crest 25 of the insert has substantially the same length as that of prior art gage inserts.

Figure 5:
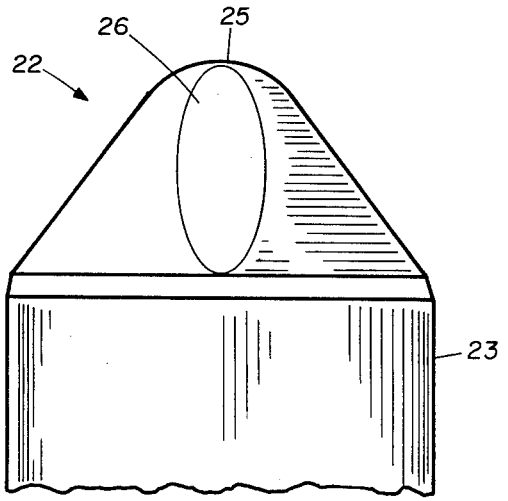
FIG. 5 is an end view of the insert shown in FIG. 4.

Referring now to FIG. 5, an end view of the insert 22 shown in FIG. 4 is illustrated. The insert 22 contacts the wall of the hole with the majority of its extended surface 26 and with substantially the same angle as the gage angle of the bit. The surface 26 is the largest plane surface on the cutting head of the insert 22. The plane surface 26 contacts the wall of the hole. Since the surface 26 is relatively large compared to the other surfaces on the insert 22, the lifetime of the insert 22 will be increased.

Figure 6:
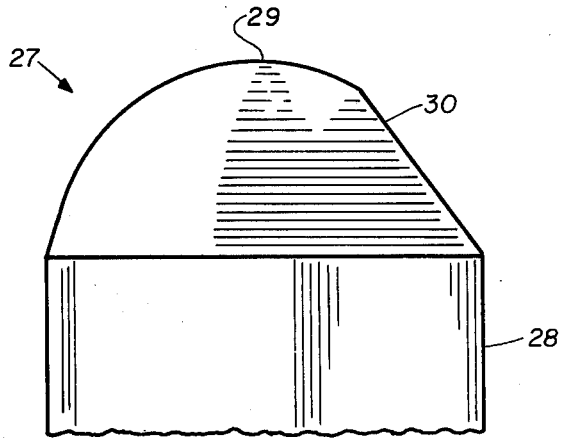
FIG. 6 is an illustration of yet another insert constructed in accordance with the present invention.

Referring now to FIG. 6, a side view of another embodiment of a gage insert 27 constructed in accordance with the present invention is illustrated. The insert 27 has a generally spherical formation contacting head 29 and a generally cylindrical body portion 28. The body portion 28 is adapted to fit within sockets in the cutter body. The outer or gage angle of the gage connecting surface 30 of this compact before gage grinding is within 1° 30′ of the gage angle of the bit. It is not necessary to grind the outer or gage surface extensively to bring the insert gage angle to the bit gage angle.

Figure 7:
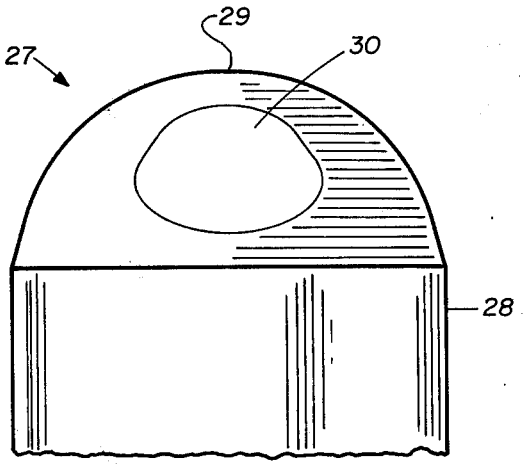
FIG. 7 is an end view of the insert shown in FIG. 6.

Referring now to FIG.7, an end view of the insert 27 shown in FIG. 6 is illustrated. The insert 27 contacts the wall of the hole with the majority of its extended surface 30 and with substantially the same angle as the gage angle of the bit. The surface 30 is the largest plane surface on the cutting head of the insert 27. The plane surface 30 contacts the wall of the hole. Since the surface 30 is relatively large, compared to other surfaces on the insert 27, the lifetime of the insert 27 will be increased.

The embodiments of the invention in which an exclusive property or privilege is claimed are defined as follows:

1. A rolling cutter for an earth boring apparatus, comprising:

a cutter body of generally conical configuration;

said cutter body having a nose and a base; and a row of gage cutting inserts positioned proximate said base, said inserts comprising pressed and sintered granules of wear-resistant material together with a binder, said inserts having a mutiplicity of surfaces culminating in a crest with one surface having a plane section substantially larger than any plane sections on any other surface, said plane section facing generally away from said nose of said cutter body.

2. A rolling cutter for a rotary rock bit, comprising:

a generally conical cutter body, said cutter body having a nose and a base; and an annular row of gage cutting shaped inserts positioned proximate said base, said shaped inserts being preformed from wear-resistant granules and said inserts having an insert base integrally joined to a crest, said insert base mounted in said cutter body and said crest having a multiplicity of converging surfaces with one surface having a plane section substantially larger than any plane section on any other surface with said plane section being oriented away from said nose of said cutter body, said multiplicity of surfaces gradually converging into said crest thereby avoiding sharp corners.

3. The rolling cutter of claim 2 wherein said conical cutter has an axis of rotation with said insert base being mounted in said cutter body substantially perpendicular to said axis of rotation and said plane section being at an angle to said base and being parallel to the gage facing section of said cutter.

4. In a rolling cutter rotary rock bit having at least one rolling cutter member for forming a borehole in the earth, said cutter member having an annular gage row of inserts mounted in sockets in the cutter member for cutting the gage of the borehole and forming a borehole wall, the improvement comprising:

said inserts comprising pressed and sintered granules of wear-resistant material together with a binder with each of said inserts having an asymmetric shape prior to assembly in the sockets that includes a gage contacting face substantially larger than any other face on said insert, said gage contacting face being oriented toward said borehole wall when cutting gage.

5. An earth boring bit having a bit body, at least one arm depending from said bit body and a bearing pin projecting from said arm; comprising:

a cone cutter rotatably mounted on said bearing pin, said cone cutter having a base; and an annular row of gage cutting inserts positioned proximate the base of the cone cutter, said inserts being shaped asymmetrically prior to assembly in said cone cutter and having an insert base integrally joined to a cutting crest, said cutting crest having a multiplicity of converging surfaces with one surface having a plane section substantially larger than any plane section on any other surface, said multiplicity of surfaces gradually converging into said crest thereby avoiding sharp corners.

6. The improvement of claim 5 wherein said inserts are comprised of pressed and sintered granules of wear-resistant material together with a binder and said cone cutter has an axis of rotation with said inserts positioned in said cutter so that said insert base is substantially perpendicular to said cone cutter axis of rotation and said plane section is positioned to be the gage cutting surface.

7. In an earth boring apparatus for forming an earth borehole by disintegrating earth formations at the bottom of the borehole leaving a borehole sidewall, said apparatus having a main body adapted to be positioned in said borehole, a multiplicity of arms extending from said main body, and a bearing pin projecting from said main body angularly away from said borehole sidewall, the improvement comprising:

a rolling cutter rotatably mounted on said bearing pin for disintegrating earth formations, said rolling cutter having individual sockets and a nose and a base with the base positioned proximate the borehole sidewall and the nose oriented away from said borehole sidewall; and an outer annular row of hard inserts mounted in said sockets in the rolling cutter, said inserts comprising pressed and sintered granules of wear-resistant material together with a binder and having a shape prior to assembly in the sockets to have a body portion to be received in the sockets and a head portion for contacting the earth formations, said head portion being asymmetrically shaped with a multiplicity of faces, one face having a plane section substantially larger than any other plane section on any of the other faces, said plane section being oriented facing away from said nose of said rolling cutter to contact said borehole sidewall.

8. The improvement in an earth boring apparatus of claim 7 wherein said rolling cutter has an axis of rotation and said body portion of said inserts are mounted in said rolling cutter substantially perpendicular to said axis of rotation and wherein said plane section of one face is positioned facing outward toward said borehole sidewall.

9. The improvement in an earth boring apparatus of claim 8 wherein said plane section extends the majority of the length of said surface and wherein said faces gradually converge to said head portion thereby avoiding sharp corners.

10. An earth boring bit for forming an earth borehole through earth formations, said bit having a bit body, three individual arms extending from said bit body, and a bearing pin extending from each individual arm, comprising:

a rolling cutter mounted on each bearing pin for forming said earth borehole, said rolling cutter having an axis of rotation, a cone base and individual sockets; and an annular row of gage inserts mounted in said sockets in the rolling cutter proximate said cone base, said inserts comprising pressed and sintered granules of wear-resistant material together with a binder and having a shape prior to assembly in the sockets that provides a body portion to be received in the sockets and a head portion with an extended surface for contacting the earth formations, said head portion being asymmetrically shaped without any sharp corners with said extended surface of said head portion being planar and being the largest planar surface on said head portion, said body portion being substantially perpendicular to said axis of rotation and said extended surface facing away from said nose of said rolling cutter.

* * * * *